US005642632A

United States Patent [19]

Nanya et al.

[11] Patent Number: 5,642,632

[45] Date of Patent: Jul. 1, 1997

[54] COATED KNITTING PARTS OF KNITTING MACHINE

[75] Inventors: Takanori Nanya, Sayama; Nobuyuki Yoshino, Kawagoe, both of Japan

[73] Assignee: Citizen Watch Co., Ltd., Tokyo, Japan

[21] Appl. No.: 501,024

[22] PCT Filed: May 30, 1994

[86] PCT No.: PCT/JP94/00855

§ 371 Date: Aug. 11, 1995

§ 102(e) Date: Aug. 11, 1995

[87] PCT Pub. No.: WO95/16809

PCT Pub. Date: Jun. 22, 1995

[30] Foreign Application Priority Data

Dec. 17, 1993 [JP] Japan ..... 5-067453 U

[51] Int. Cl.[6] ..... D04B 15/06; D04B 15/38; H05H 1/24

[52] U.S. Cl. ..... 66/104; 66/116; 66/123; 66/125 R; 427/438; 427/577

[58] Field of Search ..... 427/436, 438, 427/577, 590; 66/1 R, 116, 123, 124, 120, 125 R, 107, 109, 110, 207, 126 R, 126 A, 139, 146; 75/236, 10.19, 954; 428/546, 564

[56] References Cited

U.S. PATENT DOCUMENTS

| | | | |
|---|---|---|---|
| 4,358,923 | 11/1982 | Feldstein | 427/438 |
| 4,362,012 | 12/1982 | Le Chatelier | 427/438 |
| 4,371,573 | 2/1983 | Januschkowetz et al. | 427/438 |
| 4,510,183 | 4/1985 | Akyol | 427/438 |
| 4,666,786 | 5/1987 | Yano et al. | 427/438 |
| 5,006,367 | 4/1991 | Lancsek | 427/438 |
| 5,077,990 | 1/1992 | Plath | 66/123 |
| 5,145,517 | 9/1992 | Feldstein et al. | 427/438 |

FOREIGN PATENT DOCUMENTS

| | | |
|---|---|---|
| 58-31141 | 2/1983 | Japan . |
| 61-186558 | 8/1986 | Japan . |
| 62-28452 | 2/1987 | Japan . |
| 4-41755 | 2/1992 | Japan . |

*Primary Examiner*—C. D. Crowder
*Assistant Examiner*—Larry D. Worrell, Jr.
*Attorney, Agent, or Firm*—Armstrong, Westerman, Hattori, McLeland & Naughton

[57] ABSTRACT

In knitting parts (a jacquard guide needle, a guide, a needle, a tongue, a sinker, a separator, etc.), each having a portion which is brought into contact with a knitting yarn when fitted to a knitting machine to perform knitting, the surface of a portion of a metallic part base material (10) thereof is coated with a compound plating layer (12) made of a non-electrolytic nickel alloy plating layer including minute silicon particles dispersed therein, each of the silicon particles being coated with a hard carbon film. As a result, it is possible to improve the durability of the knitting parts similarly to those in which the surface of the part base material is coated with the hard carbon film and moreover remarkably reduce the processing cost.

7 Claims, 3 Drawing Sheets

COATED KNITTING PARTS OF KNITTING MACHINE

1. Technical Field

This invention relates to knitting parts such as a guide, a needle, a tongue, a sinker, a separator, a jacquard guide needle and the like, which have a portion contacting with knitting yarn when they are fitted to a knitting machine to perform knitting, and a method of coating the surfaces thereof, and more in detail, to a surface coating technology to improve durability of such parts with sufficient cost effectiveness.

2. Background of Technology

This invention will be described using a warp knitting machine as an example, though knitting machines include a warp, a flat, a circular knitting machine and the like, and similarly it can be applied to such a flat or circular machine.

The warp knitting machine is roughly classified into tricot and raschel machines, on which a sectional beam wound with knitting yarn or a warp end is usually mounted, the warp end being supplied therefrom to a knitting needle line to perform knitting.

The knitting parts (tool) consisting of a knitting section of a warp knitting machine comprises a thin sheet-formed "guide" of about 200 μm thickness which is located between a sectional beam and a knitting needle line and has a hole to guide knitting yarn or a warp end, a thin sheet-formed "needle" with a hook on a head end for knitted stitch formation, and a thin sheet-formed "tongue", which cooperatively participates in the knitted stitch formation together with the needle, and a "sinker", as well as a "separator", a "jacquard guide needle", etc. In general, a number of such parts are arranged parallel at very close spaces to form a block.

Generally, from viewpoints of easy processing and wear resistance, a carbon steel base material which is shaped to profile each of these parts and is coated by means of wet chromium plating, or a stainless steel base material, are used to make the various knitting parts described above.

The durability of such knitting parts, however, has been in serious question due to the increasing speed of knitting machines, diversification of materials for knitting yarn (such as high strength fibers or modified fibers), and the employment of various kinds of sizing.

Namely, the knitting parts such as guide, needle, tongue, sinker, separator, jacquard guide needle, etc., tend to wear out at a portion contacting with knitting yarn, which causes hairiness or end breakage of the yarn. Thus, the durability of such knitting parts is an important factor to decide the operational effectiveness of machines and the cost of products, because it requires a great deal of expense, effort and time to replace a great number of these parts used in a machine so as to prevent such trouble with the yarn as described above.

Then, it has been proposed to coat the surface of knitting parts (tool) for warp knitting machines with a high hardness coating of metals such as tantalum (Ta), tungsten (W), titanium nitride(TiN), titanium-tungsten alloy (TiW), etc. (see Japanese Patent Laid-Open Publication No. 4-41,755).

It has also been known, however, that the wear of knitting parts typically represented by the needle or guide is a phenomenon depending on combinations of such factors as kinds of fibers, impact pressure, vibration characteristics, etc., and that satisfactory results are not necessarily obtained by a coating of high surface hardness.

Particularly, also in the case of a needle or a guide coated with titanium nitride which is known as a coating compound having a high hardness, no increase in durability was observed compared with a conventional carbon steel base material coated by means of chromium plating, and there was the problem that the substrate was softened due to a higher treating temperature.

Further, it is also reported that the toughness of a base material itself is lost and, as a result, the durability is decreased when a coating of high hardness is thickly formed on the base material.

From this point of view, it is necessary to improve the durability without spoiling inherent properties of the base material. The inventors confirmed that it was effective to form a hard carbon film on the surface of a base material of knitting parts such as a needle, a guide, etc. in a knitting machine, and it effected a remarkable improvement of durability compared with a conventional coating by means of chromium plating alone.

Using a physical or chemical vapor deposition method such as sputtering or plasma CVD as a means for forming the hard carbon coating on the surface of the base part material, however, inevitably resulted in a high processing cost.

A knitting machine is composed of a large number of parts, all of which require a measure of durability, so that the processing cost and the number of processed parts are strictly incompatible with each other. Accordingly, a large reduction in the processing cost is indispensable for improving durability by allowing all the knitting parts of a knitting machine to be coated with the hard carbon film.

The present invention has been made from a view of such a technical background to provide the knitting parts of a knitting machine which are remarkably improved in durability without increasing processing cost so much.

DISCLOSURE OF THE INVENTION

In order to achieve the above object in the knitting parts which are fitted to a knitting machine for use according to the present invention, a metallic part base material is coated with a compound plating layer made of a non-electrolytic nickel alloy plating layer including minute silicon particles dispersed therein at least on a surface thereof which is often brought into contact with a knitting yarn, each minute silicon particle being coated with a hard carbon film on the surface thereof.

Alternatively, the hard carbon film coating the surface of each minute silicon particle set forth above may be a fluorinated hard carbon film in which a part of the hydrogen in chemical bond is replaced with fluorine.

Moreover, the surface of the part base material is directly coated with the compound plating layer when it is made of stainless steel, but when the part base material is made of carbon steel, it is preferable to form an anti-corrosion layer such as a chrome layer, a nickel layer, a nickel alloy layer etc. on the surface of the part base material and then form the compound plating layer thereon.

The hard carbon film constituting a part of the present invention is, for example, an amorphous carbon film containing hydrogen which is formed under a gaseous atmosphere of hydrocarbon by way of a plasma CVD method etc. and is known to have hardness next to diamond, high heat conductivity about five times as much as that of copper and an extremely small coefficient of friction.

Furthermore, it is also possible to adjust the fluorinated hard carbon in which a part of the hydrogen therein is replaced with fluorine by subjecting the hard carbon film to plasma processing in an atmosphere of fluorine gas such as $CF_4$ so as to further reduce the coefficient of friction thereof compared with the unprocessed hard carbon film and give high water repellency thereto.

As describe above, the compound plating layer made of a non-electrolytic nickel alloy plating layer including minute silicon particles dispersed therein, each minute silicon particle being coated with a hard carbon film on the surface thereof, has higher hardness and higher wear resistance, durability and water repellency reflecting the characteristics of the hard carbon film or the fluorinated hard carbon film, as well as the advantages of excellent adherence, corrosion resistance and wear resistance which are features of the non-electrolytic nickel alloy plating.

Accordingly, it is possible to significantly improve the durability of knitting parts of a knitting machine. Moreover, a wet plating method is a remarkably simple processing method compared with the conventional physical and chemical vapor deposition method, so that it is possible to largely reduce the processing cost for improving the durability of the knitting parts.

Figure 2:
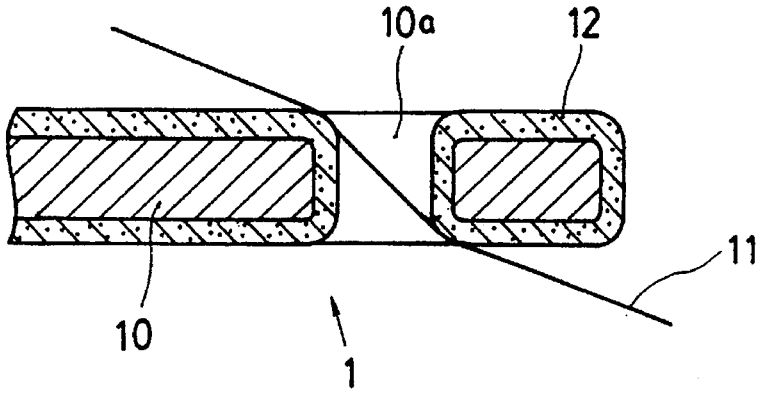
FIG. 2 is a schematic enlarged cross-sectional view of the jacquard guide needle in FIG. 1 taken along a line II—II.
Figure 4:
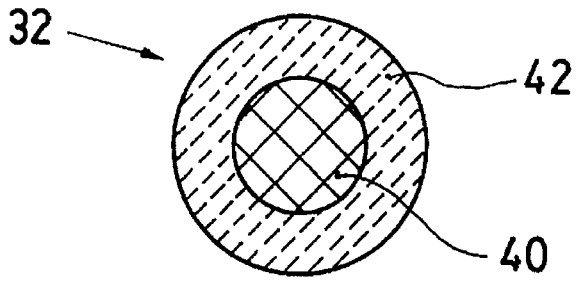
Figure 5:
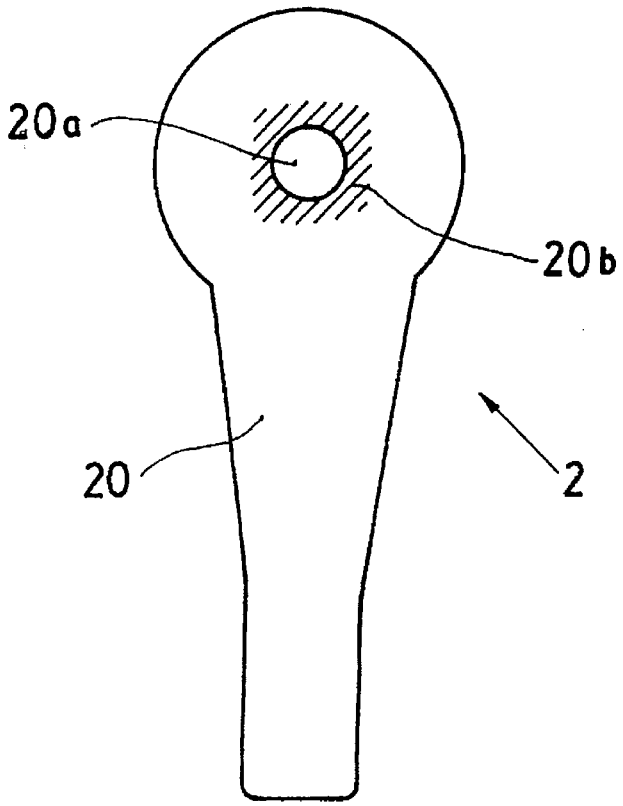
Figure 6:
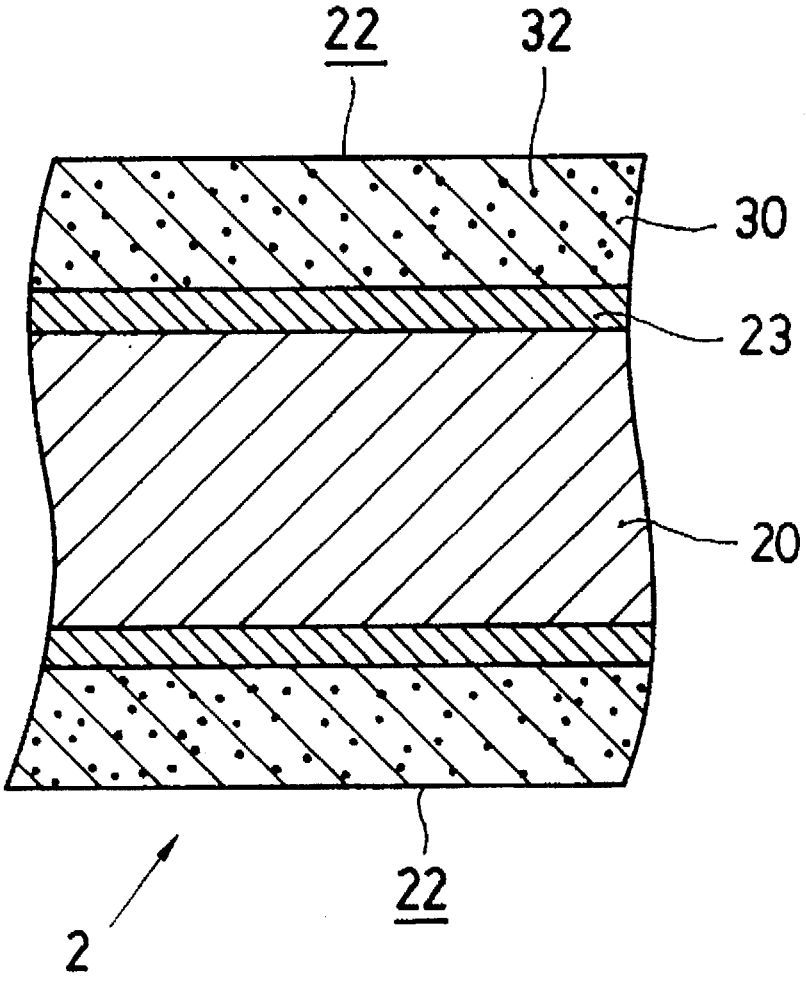

FIG. 4 is a schematic enlarged cross-sectional view of a minute silicon particle 32 coated with a hard carbon film, the minute silicon particles 32 being dispersedly included in the compound plating layer 12 as illustrated in FIG. 2;

FIG. 5 is a plan view of a guide according to the other embodiment of the present invention; and FIG. 6 is a schematic partially enlarged cross-sectional view of the guide in FIG. 5 showing the structure of its coating.

BEST MODE FOR CARRYING OUT THE INVENTION

Referring now to the attached drawings, this invention will be further described in detail.

[First Embodiment]

Figure 1:
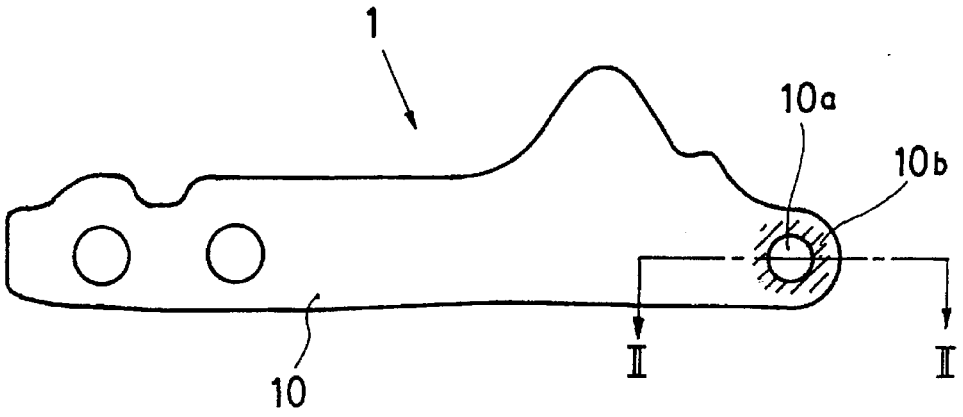
FIG. 1 is a plan view of a jacquard guide needle according to an embodiment of the present invention.

FIG. 1 is a plan view of a jacquard guide needle which is one of the knitting parts of a warp knitting machine according to an embodiment of the present invention and FIG. 2 is a schematic enlarged cross-sectional view of the jacquard guide needle in FIG. 1 taken along a line II—II.

The jacquard guide needle 1 comprises a base member 10 composed of stainless steel shaped to profile a part with a through hole 10*a* formed therein through which a pattern yarn (a pattern forming portion of a knitting yarn) 11 is passed to be guided to a needle, not shown.

The jacquard guide needle 1 is coated with the compound plating layer 12 on the surface of the base material 10 thereof (including the inner surface of the through hole 10*a*) as illustrated in FIG. 2.

The pattern yarn 11 passes aslant through the through hole 10*a* from one surface side of the jacquard guide needle 1 to the other surface side thereof.

As a result, the edge portion of the inner periphery of the through hole 10*a* and the surface of the jacquard guide needle 1 adjacent thereto are often brought into contact with the pattern yarn 11 and are worn out. The wearing portion 10*b* is hatched in FIG. 1.

Therefore the jacquard guide needle 1 according to this embodiment is coated with the compound plating layer 12 on all the surface of the base material 10 thereof or at least a part including the wearing portion 10*b* thereof.

Figure 3:
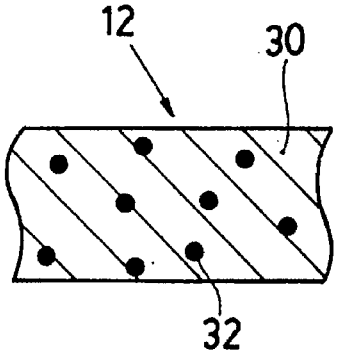
FIG. 3 is a schematic enlarged cross-sectional view of a compound plating layer 12 in FIG. 2.

The compound plating layer 12 is made of a non-electrolytic nickel alloy plating layer 30 including minute hard-carbon-film-coated particles 32 dispersed therein as illustrated in a schematically enlarged cross-sectional view in FIG. 3.

Each of the minute hard-carbon-film-coated particles 32 is a minute silicon particle 40 coated with the hard carbon film 42 as illustrated in FIG. 4.

A method of coating the base material 10 with the compound plating layer 12 will be described hereinafter.

At first, the hard carbon film 42 is formed about as thick as 1 μm on the surface of each minute silicon particle 40 having a diameter of 0.1~2 μm by way of the plasma CVD (Chemical Vapor Deposition) method.

The forming conditions are as follows.

exciting gas: methane ($CH_4$)
exciting method: high-frequency radio wave (13.56 MHz)
exciting power: 300 W
flow rate of gas: 30 $cm^3$/min.
pressure of gas: 0.1 Torr
layer formation speed: 20 nm/min.
processing temperature: ≦150° C.

At that time, minute silicon particles are uniformly placed as much as about 100~1000 g on the bottom of a metallic container so as to be less than 5 mm in thickness and the metallic container is put on an exciting electrode, and thereafter the plasma CVD method is performed while applying a high-frequency voltage and a mechanical vibration to the exciting electrode so as to uniformly coat the minute silicon particles 40 with the hard carbon film 42.

Alternatively, the plasma CVD method may be performed while stirring the minute silicon particles in the metallic container by a mixer equipped with a plastic stirring member.

It is possible to mass-produce the minute hard-carbon-film-coated particles 32 easily and at low cost since there is no need of rotating part base materials in a vacuum container while holding them to keep sufficient spaces among them for forming the hard carbon film on the surface of such a minute particle by way of the plasma CVD method unlike the case of forming the hard carbon film on the surface of the part base material.

Moreover, it is possible to replace a portion of the hydrogen in the hard carbon film 42 with fluorine so as to make a fluorinated hard carbon film by coating the surface of the minute silicon particle 40 with the hard carbon film 42 in this way and successively subjecting the same to plasma processing in an atmosphere of $CF_4$ gas.

Thereafter a compound plating bath is prepared wherein the minute silicon particles 32 are dispersed to be 20~30% by volume in a non-electrolytic nickel alloy plating solution having the following composition.

| | |
|---|---|
| $NiSO_4 \cdot 7H_2O$ | 20 g/l |
| $NaH_2PO_4 \cdot H_2O$ | 20 g/l |
| $CH_3COOHNa \cdot 3H_2O$ | 136 g/l |
| sulfuric acid 1.84 g/$cm^3$ | 10 ml/l |
| pH | 5.0 |
| fluid temperature | 90° C. |

Then the base material 10 of a jacquard guide needle (refer to FIGS. 1 and 2) made of stainless steel, the base material 10 having been successively subjected to washing, alkaline degreasing and etching by acid in advance, is soaked in the compound plating bath heated to about 90° C. for subjecting the same to non-electrolytic plating.

At that time, it is preferable to perform the plating while mechanically stirring or circulating the plating solution by way of a pump so as to uniformly disperse the minute silicon particles 32 in the plating bath. The plating film is, for example, about 10 μm thick.

The thus formed non-electrolytic nickel alloy plating layer 30 (refer to FIG. 3) should be subjected to heat treatment after plating at a high temperature (about 400° C.) to further increase the surface hardness thereof.

The composition of the thus coated compound plating layer 12 was observed by way of an electron microscope photograph and it was confirmed that the minute hard-carbon-film-coated particles 32 (the minute silicon particles 40 each coated with the hard carbon film 42 as illustrated in FIG. 4) were uniformly dispersed in the non-electrolytic nickel alloy plating layer 30 within a range of 20~30% by volume as illustrated in FIG. 3.

A plurality of jacquard guide needles 1 each comprising a base material 10 coated with the compound plating layer 12 made of the non-electrolytic nickel alloy plating layer 30 including the minute silicon particles 40 dispersed therein each coated with the hard carbon film 42 were fitted to a block, and the block was mounted on a knitting machine to test the durability of the jacquard guide needles 1. As a result, the jacquard guide needles 1 were proved to have an extraordinarily increased durability (15~50 times as much as) compared with that of the jacquard guide needle 1 which employed an unprocessed stainless steel base material.

The durability of the jacquard guide needle 1 is comparable to that coated with a hard carbon film after an intermediate layer is formed on the surface of a base material thereof by way of sputtering.

Moreover, the wet plating is a remarkably simple processing method compared with the conventional physical and chemical vapor deposition method, and employing the wet plating method set forth above dispenses with the need for controlling the processing gas while holding the base material in a vacuum container, so that the processing cost could be reduced to less than ⅕ of that of the prior art.

The above embodiment exemplified preferable values, but it is not limited to these values or value ranges.

[Second Embodiment]

FIG. 5 is a plan view of a guide which is one of the parts for a warp knitting machine according to the other embodiment of the present invention.

The guide 2 is composed of a base material 20 made of thin sheet-formed carbon steel and shaped to profile a part having a guide hole 20*a* formed about the tip end portion thereof, through which a warp yarn, not shown, passes aslant from one surface side of the guide 2 to the other surface side thereof similarly to the description of the first embodiment described with reference to FIG. 2.

Accordingly, the edge portion of the inner periphery of the guide hole 20*a* of the base material 20 and the surface portion therearound are exposed to the hardest friction and are worn out. The wearing portion 20*b* is hatched in FIG. 5.

Therefore according to this embodiment, a part or all of the base material 20 including at least the wearing portion 20*b* is coated with the compound plating layer.

FIG. 6 is an enlarged cross-sectional view of the guide 2 schematically showing the structure of coating thereon. According to this embodiment, the base material 20 made of carbon steel is coated with a wet chromium layer having a thickness of about 2 μm to form an anti-corrosion layer 23 at first.

Then all of the base material 20 coated with the anti-corrosion layer 23 or at least a necessary portion thereof including the wearing portion 20*b* is soaked in the compound plating bath to be subjected to non-electrolytic plating similarly to the case of the first embodiment.

In this way, the base material 20 coated with the anti-corrosion layer 23 is further coated with a compound plating layer 22 made of a non-electrolytic nickel alloy plating layer 30 including the minute silicon particles 32 (the same as those illustrated in FIG. 4) dispersed therein each coated with a hard carbon film (the same as the non-electrolytic nickel alloy plating layer 30 illustrated in FIG. 3) as thick as about 10 μm.

Thereafter the non-electrolytic nickel alloy plating layer 30 should be subjected to heat treatment at about 400° C. to increase the surface hardness thereof.

Since the base material 20 is made of carbon steel according to this embodiment, omitting the anti-corrosion measure provided by the anti-corrosion layer 23 results in the corrosion of the base material 20 after the preliminary cleansing process to cause a bad influence upon durability. Accordingly, forming the anti-corrosion layer 23 has a large effect.

As described above, also in the case of the guide 2, in which the base material 20 is coated with a compound plating layer made of the non-electrolytic nickel alloy plating layer including the minute silicon particles dispersed therein each coated with a hard carbon film, durability similar to the first embodiment is confirmed and in addition the processing cost is reduced.

Besides, it is suitable that a compound plating layer, made of the non-electrolytic nickel alloy plating layer including the minute silicon particles dispersed therein each coated with a hard carbon film, is about 2~20 μm thick taking into consideration the durability improving effect of the coating and economical efficiency.

Although in the above embodiments the jacquard guide needle and guide to which the present invention was applied have been described among the knitting parts of a warp knitting machine, the invention is also effectively applicable to all the knitting parts each having a portion contacting with a knitting yarn of a warp knitting machine such as a needle, a tongue, a sinker, a separator and the like.

Moreover, it is confirmed that the present invention is similarly applicable to the knitting parts of a flat or a circular knitting machine other than the warp knitting machine also.

Furthermore, introducing the anti-corrosion layer is effective for the carbon steel base material from the viewpoint of preventing corrosion. It is not the anti-corrosion layer alone that contributes to the improvement of durability, so that it need not be thick to be effective. Still furthermore, materials for forming the anti-corrosion layer are not limited to chromium but a nickel alloy layer or a compound plating layer of chromium or nickel and other materials may be applied, so that it does not matter if the anti-corrosion layer and the compound plating layer have the same composition.

INDUSTRIAL UTILIZATION

According to this invention, as has been described above, the durability of knitting parts of a knitting machine such as a needle, a guide, a tongue, a sinker, a separator, a jacquard guide needle and the like is markedly improved and, at the same time, these parts can be used for remarkably extended periods, thereby to considerably improve an operational effectiveness of knitting machines and decrease the cost of products.

Moreover, in order to improve the durability of these knitting parts, the surface of the base material is coated with a compound plating layer made of the non-electrolytic nickel alloy plating layer including the minute silicon particles dispersed therein each coated with a hard carbon film using a simple method of non-electrolytic plating wherein a part base material is soaked in a compound plating bath instead of coating the surface of a part base material with a hard carbon film using an expensive vapor deposition method such as sputtering or plasma CVD, so that the coating process is excellent in productivity and can provide knitting parts of high durability at low cost so as to rapidly come into wide use in various kinds of knitting machines.

We claim:

1. Knitting parts of a knitting machine each of said parts having a metallic portion to be brought into contact with a knitting yarn when fitted to said knitting machine to perform knitting, characterized in that said metallic portion having a coating of a compound plating layer made of a non-electrolytic nickel alloy including minute silicon particles dispersed therein, at least on a surface of said portion which is in contact with said knitting yarn during knitting, each minute silicon particle having a coating of hard carbon film.

2. Knitting parts of a knitting machine according to claim 1, characterized in that said hard carbon film is a fluorinated hard carbon film in which at least a portion of hydrogen in chemical bond is replaced with fluorine.

3. Knitting part of a knitting mechine according to claim 1, characterized in that said metallic portion is of stainless steel and all surfaces thereof have a coating of said compound plating layer.

4. Knitting parts of a knitting machine according to claim 1, characterized in that said metallic portion is carbon steel and all surfaces thereof have a coating of said compound plating layer coated on an anti-corrosion layer from the group consisting of a chrome layer, a nickel layer, and a nickel alloy layer.

5. A method of coating knitting parts of a knitting machine described in claim 3, characterized in comprising steps of;

forming minute hard-carbon-film-coated particles each coated with a hard carbon film by uniformly forming said hard carbon film on each minute silicon particle by way of plasma CVD method;

preparing a compound plating bath to disperse said minute particles, each coated with said hard carbon film, in a non-electrolytic nickel plating solution; and soaking a portion of said stainless steel to subject said portion to non-electrolytic plating and forming a compound plating layer, made of non-electrolytic nickel alloy plating layer including said minute hard-carbon-film-coated particles dispersed therein, on said portion, each of said particles being coated with said hard carbon film, said stainless steel having been successively subjected to washing, alkaline degreasing and etching by acid in advance and said portion at least includes a portion which is often brought into contact with said knitting yarn.

6. A method of coating knitting parts of a knitting machine according to claim 5, characterized in that said stainless steel, coated with said compound plating layer, is subjected to heat processing at a high temperature after forming said compound plating layer.

7. A method of coating knitting parts of a knitting machine described in claim 4 comprising the steps of:

making minute hard-carbon-film-coated particles, each coated with a hard carbon film, by uniformly forming said hard carbon film on all surfaces of each minute silicon particle by way of plasma CVD method;

forming an anti-corrosion layer selected from the group consisting of chrome, nickel and nickel alloy on all surfaces of said carbon steel; and soaking a portion of said carbon steel to subject said portion to non-electrolytic plating so as to form a compound plating layer made of a non-electrolytic nickel alloy plating layer, including said minute hard-carbon-film-coated particles dispersed therein, on said portion, each of said particles being coated with said hard carbon film, said carbon steel having been successively subjected to washing, alkaline degreasing and etching by acid in advance and said portion at least includes a portion which will often be brought into contact with a knitting yarn.

* * * * *